US010074468B2

(12) United States Patent
Inagaki et al.

(10) Patent No.: US 10,074,468 B2
(45) Date of Patent: Sep. 11, 2018

(54) POWDER MAGNETIC CORE FOR REACTOR

(71) Applicant: HITACHI CHEMICAL COMPANY, LTD., Chiyoda-ku, Tokyo (JP)

(72) Inventors: Takashi Inagaki, Matsudo (JP); Chio Ishihara, Tokyo (JP); Noriyuki Nakayama, Tsukuba (JP)

(73) Assignee: HITACHI CHEMICAL COMPANY, LTD., Tokyo (JP)

( * ) Notice: Subject to any disclaimer, the term of this patent is extended or adjusted under 35 U.S.C. 154(b) by 226 days.

(21) Appl. No.: 14/779,138

(22) PCT Filed: Mar. 27, 2014

(86) PCT No.: PCT/JP2014/058857
§ 371 (c)(1),
(2) Date: Sep. 22, 2015

(87) PCT Pub. No.: WO2014/157517
PCT Pub. Date: Oct. 2, 2014

(65) Prior Publication Data

US 2016/0071637 A1 Mar. 10, 2016

(30) Foreign Application Priority Data

Mar. 27, 2013 (JP) ..... 2013-066018

(51) Int. Cl.
*H01F 3/08* (2006.01)
*H01F 27/255* (2006.01)
(Continued)

(52) U.S. Cl.
CPC ..... *H01F 3/08* (2013.01); *H01F 1/26* (2013.01); *H01F 27/255* (2013.01); *H01F 41/0246* (2013.01); *H01F 1/24* (2013.01)

(58) Field of Classification Search
None
See application file for complete search history.

(56) References Cited

U.S. PATENT DOCUMENTS 5,160,447 A * 11/1992 Ishikawa ..... C04B 35/63424 252/62.54
5,449,419 A * 9/1995 Suzuki ..... G11B 5/127 148/305

(Continued)

FOREIGN PATENT DOCUMENTS

CN 1615528 A 5/2005
CN 1783370 A 6/2006

(Continued)

OTHER PUBLICATIONS

Abstract of JP 2008-063651 A (pub. 2008).*

(Continued)

*Primary Examiner* — Kevin M Bernatz
(74) *Attorney, Agent, or Firm* — Nath, Goldberg & Meyer; Jerald L. Meyer

(57) ABSTRACT

Provided is a powder magnetic core for a reactor, whose electromagnetic properties are difficult to change with time, even when applied to a reactor used in a state that the core is exposed without being potted. The powder magnetic core for a reactor consists essentially of a compact composed of an insulation-coated iron-based soft magnetic powder that an insulating film is formed on the surface of an iron-based soft magnetic powder, and which has such a change with time of 500 hours at 180° C. that a ratio of decrease in effective magnetic permeability being 1% or less. In the compact, the content of gapping between two adjacent particles of the insulation-coated iron-based soft magnetic powder is 2 vol % or less.

5 Claims, 4 Drawing Sheets

(51) Int. Cl.

| | |
|---|---|
| ***H01F 41/02*** | (2006.01) |
| ***H01F 1/26*** | (2006.01) |
| *H01F 1/24* | (2006.01) |

(56) References Cited

U.S. PATENT DOCUMENTS

| | | | | |
|---|---|---|---|---|
| 6,083,325 | A * | 7/2000 | Bitoh | H01F 1/15308 148/121 |
| 2009/0226751 | A1* | 9/2009 | Mitani | B22F 1/0007 428/552 |
| 2010/0051851 | A1* | 3/2010 | Mitani | B22F 1/0007 252/62.54 |
| 2010/0060539 | A1* | 3/2010 | Suetsuna | H01F 1/33 343/787 |
| 2012/0038532 | A1* | 2/2012 | Yonetsu | B22F 1/0062 343/787 |
| 2013/0056674 | A1* | 3/2013 | Inagaki | B22F 1/007 252/62.55 |
| 2013/0228716 | A1* | 9/2013 | Suetsuna | B22F 1/02 252/62.55 |
| 2013/0342069 | A1* | 12/2013 | Rowe | C04B 35/62807 310/216.066 |
| 2016/0293309 | A1* | 10/2016 | Inagaki | H01F 3/08 |

FOREIGN PATENT DOCUMENTS

| | | | | |
|---|---|---|---|---|
| CN | 101053047 | A | | 10/2007 |
| CN | 101479062 | A | | 7/2009 |
| CN | 102693826 | A | | 9/2012 |
| CN | 102822913 | A | | 12/2012 |
| CN | 102834208 | A | | 12/2012 |
| JP | H06260319 | A | | 9/1994 |
| JP | H09102409 | A | | 4/1997 |
| JP | H10189323 | A | | 7/1998 |
| JP | 2000312484 | A | | 11/2000 |
| JP | 3575328 | B2 | | 7/2004 |
| JP | 2005072198 | A | | 3/2005 |
| JP | 2005213621 | A | | 8/2005 |
| JP | 200759656 | A | | 3/2007 |
| JP | 2007211340 | A | | 8/2007 |
| JP | P4004591 | B2 | | 8/2007 |
| JP | P4044591 | B1 | | 11/2007 |
| JP | 2008063651 | A | * | 3/2008 ..... B22F 1/0007 |
| JP | 2008231443 | A | | 10/2008 |
| JP | 2009231495 | A | | 10/2009 |
| JP | 2011233860 | A | | 11/2011 |
| JP | P4927983 | B2 | | 2/2012 |
| JP | 2012134244 | A | | 7/2012 |
| WO | 2008/032503 | A1 | | 3/2008 |
| WO | 2011/118774 | A1 | | 9/2011 |
| WO | 2012/115137 | A1 | | 8/2012 |

OTHER PUBLICATIONS

Abstract of WO 2011-126119 A1 (publ. 2011).*

Machine Translation of JP 4927983 A. (Year: 2012).*

Office Action dated Jun. 27, 2016 issued in corresponding to Chinese Application No. 201480018463.9.

Official Action dated Jan. 10, 2017 in counterpart Japanese Application.

Official Action dated Feb. 28, 2017 in corresponding the counterpart Chinese Patent Application No. 201480018463.9.

Form PCT/ISA/237.

Japanese office action dated Oct. 10, 2017 for counterpart Japanese application with English translation.

The Notification of the Third Office Action dated Aug. 31, 2017 corresponding to Chinese application No. 201480018463.9.

* cited by examiner

POWDER MAGNETIC CORE FOR REACTOR

This is a National Phase Application filed under 35 U.S.C. 371 as a national stage of PCT/JP2014/058857, filed Mar. 27, 2014, an application claiming the benefit of Japanese Application No. 2013-066018, filed Mar. 27, 2013, the content of each of which is hereby incorporated by reference in its entirety.

TECHNICAL FIELD

The present invention relates to a powder magnetic core for a reactor, which is suitable for a core of the reactor used for control and regulation of the power supply, and relates particularly to a power magnetic core suitable for a core of the reactor that is used in the exposed state without potting, in solar power systems, wind power generation systems, water heaters with natural refrigerant heat pump, and the like.

BACKGROUND ART

A reactor is a passive element which is assembled by winding a coil on a core, and, as the core, a core (iron core) formed of a homogeneous magnetic material, or a core that is obtained by integrating a plurality of pieces of divided magnetic material by bonding or the like is used. In regard to automotive reactors or the like, the reactor assembled is housed into a case, and sealing (so-called potting) with an insulating resin or the like is performed before use, in order to eliminate the effect (especially vibrations) from the surroundings (see, for example, Patent Literature 1). On the other hand, in stationary applications such as use in the solar power system, wind power generation system, water heater with natural refrigerant heat pump, etc., the reactor is often used in a bare state without potting in the case (for example, refer to Patent Literature 2), because it is not subjected to vibration, unlike the vehicle use.

AS the material of the reactor core, silicon steel sheets containing 3 to 6.5% Si in Fe or the like materials are conventionally used. However, the silicon steel sheets are hard and poor in moldability. Therefore, application of the powder magnetic core which is obtained by compacting a soft magnetic powder having an insulating film on the surface thereof is spreading from the viewpoint of inexpensiveness and excellent moldability (for example, see Patent Literature 3).

CITATION LIST

Patent Literature

Patent Literature 1: Japanese Patent Application Laid-Open No. 2005-72198

Patent Literature 2: Japanese Patent Application Laid-Open No. 2000-312484

Patent Literature 3: Japanese Patent Application Laid-Open No. H9-102409

SUMMARY OF INVENTION

Technical Problem

The potted reactor is shut off from the atmosphere by the case and the insulating resin or the like, and it is less susceptible to outside influences. In contrast, the reactor that is not potted is exposed to the atmosphere and it is relatively easily affected by the ambient even when it is coated with a varnish or the like after the assemblage. In particular, in the case of using, as the core, a powder magnetic core obtained by compacting soft magnetic powder, the influence of the surroundings may lead to its interior due to organizational structure of the material. Therefore, heat generation, efficiency loss with time, reduction of the heat-resistant life and the like are concerned. As a result, it becomes necessary to apply some additional heat generation countermeasures such as a cooling device or the like to the equipment that is incorporated with the reactor. It is thus disadvantageous in terms of production cost of the apparatus.

An object of the present invention is to provide a powder magnetic core suitable for use as a reactor core that electromagnetic properties hardly change with time even in application with no potting.

Moreover, another object of the present invention is to provide a powder magnetic core for a reactor that is suppressed from increase in iron loss and hysteresis loss even when used in the state of being exposed to the atmosphere, and that shows stable characteristics over the time.

Technical Solution

In order to solve the above problems, the inventors of the present application have conducted diligent studies, and as a result, it has been found that heat generation and efficiency lose with time, occurring when using a powder magnetic core as the reactor core, are due to an increase in iron loss, in particular due to an increase in hysteresis loss, and the present invention which makes possible to inhibit increase of hysteresis loss with time has been thus completed.

According to an aspect of the present invention, the subject matter of the powder magnetic core for a reactor resides in that it is a powder magnetic core for a reactor, to be applied to a reactor that is used in a state that a core is exposed without being potted, and it consists essentially of: a compact formed of an insulation-coated iron-based soft magnetic powder that an insulating film is formed on the surface of an iron-based soft magnetic powder, the compact having such a change with time of 500 hours at 180° C. that a ratio of decrease in effective magnetic permeability is 1% or less than 1%.

Moreover, according to another aspect of the present invention, the subject matter of the powder magnetic core for a reactor resides in that it is a powder magnetic core for a reactor, to be applied to a reactor that is used in a state that a core is exposed without being potted, and it consists essentially of: a compact formed of an insulation-coated iron-based soft magnetic powder that an insulating film is formed on the surface of an iron-based soft magnetic powder, wherein a content of gapping between two adjacent particles of the insulation-coated iron-based soft magnetic powder in the compact is 2% by volume or less than 2% by volume.

Advantageous Effects of Invention

According to the present invention, it is possible to obtain a powder magnetic core that an increase in iron loss due to an increase in the elapsed time is suppressed even in use in the state of being exposed to the atmosphere. Therefore, the powder magnetic core is suitable for a reactor core that heat generation and efficiency reduction with time be suppressed even in use without potting, and a powder magnetic core suitable for reactor core which is to be used in the exposed state is possibly provided.

MODE FOR CARRYING OUT THE INVENTION

Figure 1:
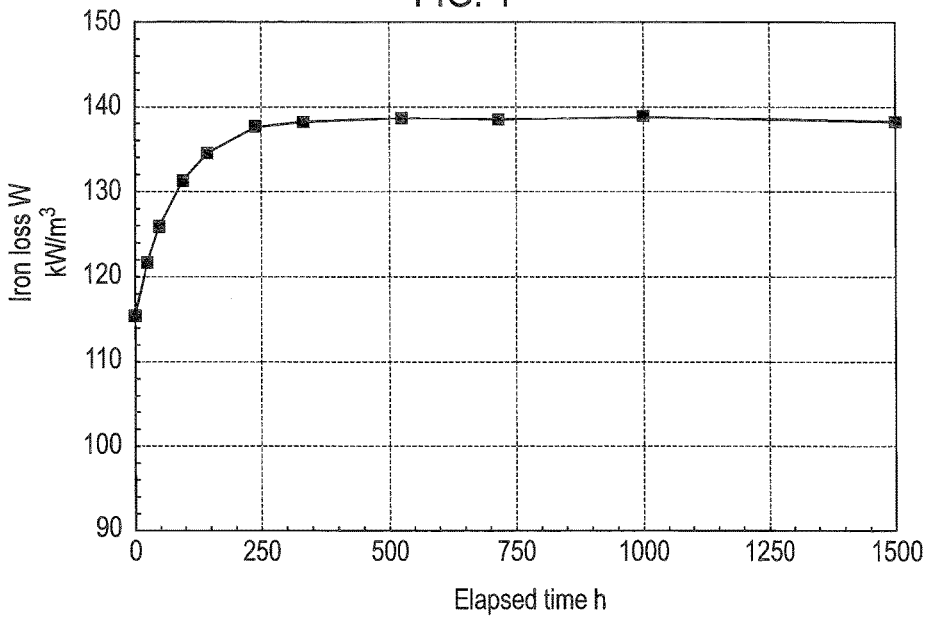
FIG. 1 A graph showing the change in the iron loss W with the elapsed time, in the case of applying a powder magnetic core to the reactor core on which potting is not carried out.

The reactors applied to various power generation systems have not been guaranteed for use at room temperature, and the ambient temperature of the reactor rises depending on the installation environment and the usage of the system. In order to explore the cause of heat generation and efficiency reduction with time that occur when a powder magnetic core formed of an insulation-coated iron powder obtained by subjecting the iron powder to the insulation coating on the surface thereof is used as the reactor core, the inventors of the present application have investigated the changes in magnetic characteristics of the reactor core being not potted when it was placed in a heated state. Consequently, a result as shown in FIG. 1 was obtained. FIG. 1 shows a result of examining the change in iron loss W with the elapsed time, by: configuring the reactor having as the core a powder magnetic core prepared using iron powder, Somaloy 110i (5P) manufactured by Höganäs AB Co.; allowing it in a predetermined time period to stand in a 180° C. air in a state of being not potted; and then measuring iron loss W in the frequency of 10 kHz at the magnetic flux density of 100 mT. According to FIG. 1, it is shown that the iron loss W, whose initial value is about 115 kW/m$^3$, is increasing up to about 138 kW/m$^3$, i.e. 1.2 times, with the passage of the heating time. In other words, the iron loss of the powder magnetic core has been found to increase as time passes. When the iron loss is increased as shown in FIG. 1, not only the efficiency of the element is reduced, heat is also generated and service of the reactor is reduced.

In an electromagnetic steel sheet, the iron loss W can be represented by the sum of eddy current loss $W_e$ and hysteresis loss $W_h$ as shown in the formula (1) below, and the eddy current loss $W_e$ and the hysteresis loss $W_h$ can be shown by the following formula (2) and formula (3). In the formula (2) and formula (3), f represents the frequency, $B_m$ is the excitation magnetic flux density, ρ is an intrinsic resistance value, t is a thickness of a material, and $k_1$ and $k_2$ are coefficients.

$$W=W_e+W_h \tag{1}$$

$$W_e=(k_1B_m^2t^2/\rho)f^2 \tag{2}$$

$$W_h=k_2B_m^{1.6}f \tag{3}$$

According to the formula (2), the eddy current loss $W_e$ is increased in proportion to the square of the thickness t of the material. To reduce the eddy current loss $W_e$, it is necessary to confine the eddy currents to a small area. By applying it to a powder magnetic core, the eddy currents are confined inside the soft magnetic power particles by forming an insulation film on the surface of each of the soft magnetic powder particles, and, at the same time, by compacting it densely, it is attempt to enhance the magnetic flux density and reduce the iron loss. In such a powder magnetic core, since the eddy current loss $W_e$ increases when the insulation is insufficient, the present inventors had considered the cause of increased iron loss in FIG. 1 as being deterioration of the insulation film due to aging and they measured the breakdown of the iron loss in the powder magnetic core. The result of the measurement is shown in FIG. 2.

Figure 2:
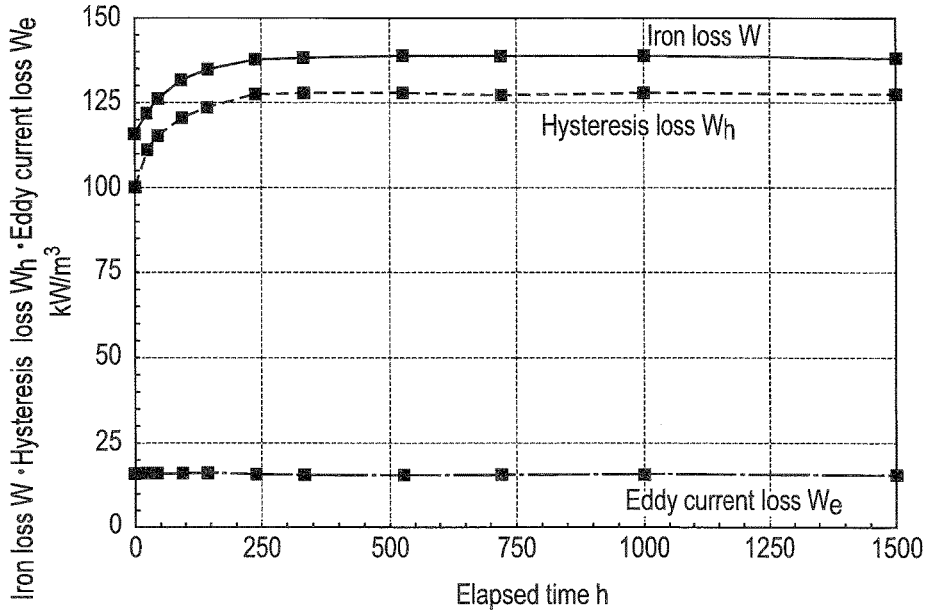
FIG. 2 A graph showing the breakdown (eddy current loss $W_e$ and hysteresis loss $W_h$) of iron loss W of the powder magnetic core shown in FIG. 1.

However, according to FIG. 2, unlike the above forecast, the eddy current loss $W_e$ are stable regardless of the elapsed time and it has been found that increase with time in iron loss is due to an increase in hysteresis loss $W_h$. Therefore, to suppress the increase of iron loss W with time, it is necessary to suppress the increase of hysteresis loss $w_h$ with time.

By the way, the magnetic permeability μ in the alternating magnetic field is equal to the slope of the magnetization curve (B-H curve) that is a relationship between the strength H of the magnetic field and the magnetic flux density B, and the hysteresis loss $W_h$ corresponds to the area in the magnetization curve. Thus the present inventors can refer that those showing the magnetization curve being close to a straight line, or, those having a small change in the tangent slope of the magnetization curve (differential permeability) have small hysteresis loss $W_h$, and that those having a small variation with time in the magnetic permeability are small in increase with time in the hysteresis loss $W_h$. In other words, a powder magnetic core having a property that magnetic permeability is invariable (differential permeability is stable) is advantageous in suppressing the increase with time in the hysteresis loss, and a reactor can also be used in a state that the core is exposed with no potting, while the iron loss of the core does not increase with time and stable and good characteristics are exhibited.

Specifically, the powder magnetic core for a reactor of the present invention is characterized by consisting of a powder magnetic core that change with time in the magnetic permeability is 1% or less, and it can be suitably used as a core of a reactor which is used in the state that the core is exposed, without being potted in the case. The powder magnetic core that change with time in the magnetic permeability is 1% or less is produced by compaction-forming an insulation-coated soft magnetic powder that an insulating coating is formed on the surface of a soft magnetic powder having an iron-based composition, and the core formed is subjected to a heat treatment before providing for use. At this time, the content of gapping between two particles adjacent to each other of the insulation-coated iron-based soft magnetic powder is adjusted to 2% by volume or less, and then the above character is achieved. In detail, changes with time in the permeability is due to oxidation of the soft magnetic powder, and the gapping between two adjacent particles of the insulation-coated iron-based soft magnetic powder acts as a communication hole through which the inside of the powder magnetic core of reactor is communicated with and exposed to the external atmosphere, resulting in easy proceeding of oxidation in the soft magnetic powder. Meanwhile, in such a state of close contact between two adjacent particles of the insulation-coated iron-based soft magnetic powder that the content of gapping between two particles is 2% by volume or less, gaps hardly communicates and the inside of the powder magnetic core of the reactor is prevented from being exposed to the atmosphere. Thus oxidation of the soft magnetic powder is suppressed. Also in this state, voids (so-called pores) may be formed between three or more particles of the insulation-coated iron-based soft magnetic powder. However, since these voids (pores) are liable to be closed pores, the powder magnetic core of the reactor can be regarded as substantially free from communication with the outside.

Incidentally, the volume ratio of the gapping in the three dimensional structure can be approximately measured as an area ratio of the gapping in the two-dimensional structure. Therefore, the content (volume ratio) of gapping between two particles of the power magnetic core can be determined as an area ratio of the gapping in a cross section of the powder magnetic core. Specifically, the cross section of the powder magnetic core is mirror polished; the cross section is then observed at 3,000 times magnification with use of a Scanning Electron Microscope (SEM) or an Electron Prove Micro-Analyzer (EPMA) having the same function or the like; it is photographed by adjusting so as to fit the interface between two particles into the field of view and prevent voids (pores) surrounded by three or more particles; and the area ratio of the gapping is determined by analysis of the captured image, which can be regarded as the volume ratio of the gapping. For the analysis of the image, image analysis software such as WinROOF produced by MITANI CORPORATION, QuickGrain Standard produced by Inotech Co., Ltd. and the like may be used to measure the area ratio of the gapping by setting the threshold to about 85 in the mode method.

For the insulation-coated soft magnetic powder, the following ones can be suitably used.

1) a soft magnetic powder which has a phosphoric acid-based chemical conversion coating and a silicone resin coating formed in this order on the surface thereof, wherein the phosphoric acid-based chemical conversion coating contains one or more elements selected from the group consisting of cobalt, sodium, sulfur, silicon and tungsten, and 2) a soft magnetic powder having an insulating layer containing a particulate metal oxide and calcium phosphate, wherein the insulating layer formed on the surface of the powder is brought into contact with a silicone resin.

The insulation-coated soft magnetic powder of the above 1) may be obtained as described in Japanese patent No. 4044591, and the insulation-coated soft magnetic powder of the above 2) may be obtained as described in Japanese Patent No. 4927983. In the powder of the above 1), the heat resistance of the phosphoric acid-based chemical conversion coating is improved by introduction of the elements such as cobalt, sodium, etc. In the powder of the above 2), the insulating layer belongs to the phosphate conversion coating and the strength and the like of the insulating layer is improved by introduction of the metal oxide particles. Thus a green compact having a stable permeability at high magnetic field can be obtained using them. By the contact with the silicone resin, a silicone resin film is formed on the surface (and internal) of the insulating layer of 2). The common point of these powders is that the insulating coating covering the soft magnetic powder is a multi-layer film having an inorganic and phosphorus acid-based coating on the inside and an organic silicone resin coating on the outside, and the phosphoric acid-based coating contains such a component as cobalt, calcium, etc. Since the silicone resin on the outside exhibits lubricity, these powders exhibit good flowability and compressibility and they can be formed into a green compact without using a so-called powder lubricant such as higher fatty acids, metal salts of higher fatty acid, hydrocarbon-based waxes and the like. This point is advantageous in suppression of the deterioration or change over time in a heated state that is due to the gapping between the powder particles in the green compact formed. In a typical powder compacting, a raw material powder into which a powder lubricant such as higher fatty acids, metal salts of higher fatty acids, hydrocarbon waxes and the like is blended is used. When it is formed into compact by compression and subjected to heat treatment, the powder lubricant particles in the compact is decomposed and gasified in the heat treatment process. That is, particles of the powder lubricant located between the insulation-coated iron-based soft magnetic powder particles are lost, and gap is formed between two adjacent particles of the insulation-coated iron-based soft magnetic powder. At the same time, the gas generated from the powder lubricant particles is expanded to push the gap and escape from the compact to the outside, whereby a communication hole is formed to communicate the interior of the compact to the outside. Also when the powder lubricant is given by coating it on the surface of the insulation-coated iron-based soft magnetic powder, instead of adding it in the form of a powder, the gap and the communication hole are similarly formed by the decomposition gasification of the powder lubricant. In contrast to the above, when the powder magnetic core is formed of only the insulation-coated iron-based soft magnetic powder without using a heat-decomposable powder lubricant such as described above, formation of gap and communication hole is avoided. Therefore, it is possible to suppress the change with time in the magnetic properties caused by the internal oxidation or deterioration in the heated state.

For this reason, in order to obtain a powder magnetic core which the variation with time in magnetic properties is small, it is most preferred that a raw material containing no powder lubricant and comprising only the insulation-coated iron-based soft magnetic powder is used to be formed by compaction and subjected to the heat treatment. If blending the heat decomposable powder lubricant as described above into the raw material powder, it is necessary to set the content of the powder lubricant 0.05 mass % or less.

It is noted that, if the galling occurs on the die during the forming by compaction with use of the above raw material powder, it is possible to prevent the die galling by forming it with application of a so-called die lubrication method that a coating film is formed by applying a die lubricant to the inner wall of the die for compaction-forming the raw material powder. In this case, although the lubricant is deposited on the surface of the green compact formed by compaction, the green compact has no powder lubricants existing in the interior thereof. Therefore, the communication hole due to gasification of the powder lubricant is not formed inside the powder magnetic core after the heat treatment, and oxidation hardly occurs in the iron-based soft magnetic powder.

The soft magnetic powder is a powder having a material composition whose main component is iron and being conventionally used in the manufacture of powder magnetic cores, that is, a powder of pure iron or iron alloy. For example, iron powder, Fe—Al alloy powder, silicon steel powder, sendust powder, amorphous powder, permendur powder, soft ferrite powder, permalloy powder, amorphous magnetic alloy powder, nano-crystal magnetic alloy powder and the like are mentioned for the soft magnetic powder. It may comprise a modifying element such as aluminum, nickel, cobalt and the like, and inevitable mount of impurities (carbon, sulfur, chromium, oxygen, manganese, etc.). Preparation of the soft magnetic powder is not particularly limited and it may be any of pulverized powder, water atomized powder, gas atomization powder, gas water atomized powder and the like. Gas atomized powder that is easily obtained in a powder form close to the spherical shape is preferred in view of easiness to suppress the damage of particles during forming the compact. From the point of suppressing the eddy currents of the powder magnetic core, a soft magnetic powder having a particle size in the range of 1 to 300 μm, preferably having an average particle diameter (by laser diffraction scattering method) of about 50 to 150 μm is used. One having small particle size is high in coercivity and the effect of reducing the hysteresis loss due to the heat treatment is limited in it, but it is small in eddy current loss. So, on the balance of these matters, it is advantageous in decreasing of the eddy current loss and hysteresis loss to use a soft magnetic powder that particles in the range of 45 to 75 μm are the main and preferably occupy 50% or more in the particle size distribution.

The soft magnetic powder is coated with a phosphoric acid-based coating by chemical treatment with an aqueous treatment liquid composed mainly of orthophosphoric acid. Specifically, it can be carried out according to the literature referred for the formation of phosphoric acid-based chemical coating and a silicone resin coating on the surface of the soft magnetic powder. Alternatively, known techniques relating to phosphating treatment of metal powders (for example, Japanese Patent No. 2710152, Japanese Patent Application Laid-Open No. 2005-213621, etc.) may be referred to. The elements of cobalt, sodium, sulfur, silicon, tungsten and the like can be introduced into the coating by incorporating them into the aqueous treatment liquid in the form of a phosphate compound. To form a coating as an insulating layer containing calcium phosphate as above 2), an aqueous solution containing calcium ions, an aqueous phosphoric acid solution and a soft magnetic powder are combined and the pH is adjusted to basic in the mixed state, whereby calcium phosphate is deposited on the surface of the soft magnetic powder. By carrying out this process in the presence of a metal oxide powder, the insulating layer formed on the soft magnetic powder contains the metal oxide particles and calcium phosphate. For the metal oxide, one having a particle size of about 10 to 50 nm, preferably about 10 to 100 nm, and more preferably about 10 to 50 nm is used. As the thickness of the phosphoric acid-based coating, it may be adjusted by the formulation and the amount of the treatment liquid used.

The phosphoric acid-based coating is a good insulating film having the function of suppressing the oxidation of the soft magnetic powder, and it further serves to combine the silicone resin and the soft magnetic powder. Silicone resin is difficult to bond directly to the soft magnetic powder due to its low affinity for the metal, but it is capable of coating the soft magnetic powder through the phosphorus acid-based coating since it has an affinity or binding nature for a polar substance such a phosphoric acid compounds and metal oxides.

To the insulation-coated soft magnetic powder that is coated with the above-described phosphoric acid-based coating, an organic solvent solution of the curable silicone resin is applied and then dried, whereby silicone resin coating film is formed on the powder surface. Furthermore, the resin coating film is cured by condensation of the hydroxyl groups therein, whereby it becomes a silicone resin film insoluble in a solvent. The organic solvent of the silicone resin solution may be any one capable of dissolving the silicone resin and it may be selected as needed from those conventionally used in the preparation of a silicone resin solution. Drying of the powder coated with the resin solution is to proceed by heating to a temperature at which the organic solvent is volatilized, and a temperature of about 60 to 80° C. can be generally applied in the case of alcohol or petroleum-based organic solvent. Drying is possibly facilitated by air drying or vacuum. Since curing of the silicone resin coating film proceeds by heating to about 100 to 250° C., drying and curing can be performed simultaneously or in succession in one step if the temperature at the time of drying is set in the range of the curing temperature.

The curable silicone resin which is applied to the insulation-coated soft magnetic powder is a condensation product of silanols (containing tri-functional or tetra-functional silanol) produced by hydrolysis of a hydrolysable silane compound (chlorosilanes, etc.), that is, a polysiloxane, and it has a structural unit of polydimethylsiloxane type, polymethylphenylsiloxane type, polydiphenylsiloxane type or the like, depending on the substituent bonded to the silicon of the silanol. Since tetra-functional silanol has very high reactivity, a condensate of silanol product in which the proportion of tri-functional silanol is about 60 mol % or more, and preferably about 80 mol % or more (the balance bi-functional silanol) can be used as the silicone resin in the present invention. When the number of methyl groups is large, the volume reduction ratio by compression of the silicone resin is large. Considering further the heat resistance of the resin, the ratio of methyl groups to phenyl groups in the substituents bonded to silicon is preferably about 4:6 to 8:2. The molecular weight Mw of about 2,000 to 200,000 and the hydroxyl value of about 1 to 5% by mass may be well.

Curing of the silicone resin is to form a crosslink with a siloxy bond by the condensation of hydroxyl groups bonded to the silicon, and the resin is suitably cured by heating it at about 100 to 250° C. for about 5 to 100 minutes. Intermolecular distance in the silicone resin is longer than those in the carbon-based resins, and it is so easy to cause volume shrinkage by curing. Thus, with this in mind, it is appropriate to adjust the amount of the resin solution to be applied, so that a thickness of the silicone resin coating film after the curing is about 10 to 500 nm, preferably 20 to 200 nm.

If the thicknesses of the phosphate coating and the silicone resin film formed on the surface of the soft magnetic powder are thin, the electrical insulation may not be ensured and, at the same time, it is easy for oxygen to oxidize the soft magnetic powder through these coatings. Therefore, it is preferred that the total thickness of these films is set to be 50 nm or more. In this regard, although it is ideal that the phosphoric acid-based film and the silicone resin film are of a uniform film thickness, it is difficult to uniformly coat the soft magnetic powder surface since the soft magnetic powder is irregular in shape. Therefore, the insulating film is formed on the surface of the soft magnetic so as to have a film thickness of at least 50 nm, whereby the insulation is ensured even at the thinnest portion. In addition, it is preferred that the sum of the film thickness of the phosphoric acid-based coating and the film thickness of the silicone resin coating is set to be about 1,500 nm or less. It is noted that there is a tendency that the hydroxyl groups in the silicone resin are not completely fit the condensation in the thermal curing and unreacted hydroxyl groups may remain. In particular, a hydroxyl group in the outer surface of the cured resin may remain. As the reason, it is conceivable that, since the constituents of the above-described phosphoric acid-based film can act catalytically to the silicone resin, heat-curing of the silicone resin easily proceeds toward the outer surface from the contact interface with the phosphoric acid-based film. If this tendency is remarkable, the hardness in the cured silicone resin film is higher at the inside than that of the outer circumferential side.

The insulation-coated soft magnetic powder obtained by forming the silicone resin coating is received in the die and is then compacted by pressing at a contact pressure of about 400 to 2,000 MPa to form a green compact so that surface factor of the soft magnetic powder (calculated as a density ratio to the true density) is about 90% or more. When the soft magnetic powder is iron powder, the space factor of the soft magnetic powder can be 90% or higher if the density of the green compact is about 7.0 g/cm$^3$ or more. When the density of the green compact is set to be 7.2 g/cm3 or higher, the space factor of the soft magnetic powder is 92% or higher and that is thus preferable. Since the compressibility of the powder is good with the lubricity of the silicone resin coating film, the compacting may be done by any of cold pressing and hot pressing. If hot pressing is performed by heating to approximately 100 to 250° C., it is possible to relax the compressive strain at the pressing time and the hot pressing at the above temperature is thus effective to obtain a compact which is small in hysteresis loss. Since the powder coated with a silicone resin film has good fluidity, powder lubricants like metal soaps and fatty acids such as waxes are not required in the compacting. For the insulation-coated soft magnetic powder that the surface of the soft magnetic powder is coated with the phosphoric acid-based film and the silicone resin coating, ones provided commercially may be used and they include, for example, the powders MH20D, MH23D and MH45D manufactured by Kobe Steel Ltd., and the like.

The green compact formed is subjected to heat treatment (annealing) in order to reduce the hysteresis loss due to compressive strain. The compact which has undergone the heat treatment is a powder magnetic core usable as a reactor core. In this heat treatment, crystal grains of the soft magnetic powder are coarsened. However, if the temperature exceeds 800° C., hysteresis loss is rather increased by refinement of the crystal grains due to recrystallization of the soft magnetic powder. Therefore, the temperature of the heat treatment may be about 400 to 800° C., preferably about 600 to 700° C., and the treatment time may be about 1 to 300 minutes, preferably about 10 to 60 minutes. The heat treatment is preferably carried out under a non-oxidizing environment and it may be performed, for example, under vacuum or in an inert gas atmosphere such as hydrogen, nitrogen, argon and the like. The cooling rate after the heat treatment is desirably about 2 to 20/min, so as not to cause the refining of crystal grains. In this heat treatment, the hydroxyl groups remaining in the silicone resin film are capable of reacting. In particular, in the vicinity of the contact interfaces of the powder particles closely contacting with each other by the compaction forming, i.e., of the contact surfaces of the silicone resin coating films, condensation reaction is likely to proceed to form a crosslinking bond between the silicone resin coating films, which contributes to improving the strength of the compact. At this time, it may cause contraction due to the condensation reaction at the interface portions of the silicone resin coating films. However, this is not such a large contraction as making a gap between the powder particles being in close contact, but has rather a degree in convenient to reduce the compression strain generated in the insulation-coated soft magnetic powder at the time of compacting, and gapping between the powder particles can also be reduced.

Since the organic carbon compounds such as fatty acids and hydrocarbons are ready to be thermally decomposed in the temperature range for the heat treatment of the above green compact, in the case of using a lubricant such as waxes and metallic soaps, it is decomposed and burned so that it does not remain almost throughout the compact. Condensation reaction between the silicone resin films is not inhibited, either. Therefore, when using the compact which has undergone the heat treatment as a reactor core, change due to the lubricant does not occur even if the temperature is raised to about 150° C., and it does not become a growth factor of hysteresis loss. Space factor of the soft magnetic powder in the compact after the heat treatment is maintained to the value before the heat treatment, and it is at least about 90%.

Since the eddy current loss is not involved in the increase with time in the iron loss when used as a reactor core, increase of hysteresis loss is not due to such a change as reducing in the electrical resistance of the insulation coating, but is related to the factor which may affect the soft magnetic powder particles. The effect of the present invention is considered to be an effect by inhibiting such a factor. For the factor affecting the soft magnetic powder, there are mentioned deterioration of the soft magnetic powder (iron) by oxidation, invasion of impurities and change in the grain boundary (grain refining). In the powder magnetic core formed using the insulation-coated soft magnetic powder, oxygen in the atmosphere coming into contact through cracks that may occur in the insulation coating at the time of compacting, and oxygen constituting the phosphoric acid-based coating film, are considered as oxygen source of the oxidation. Then an oxidizable component contained in the phosphoric acid-based coating film is considered as one of the oxidation suppressing elements for the soft magnetic powder. Since the components such as cobalt, sodium, sulfur, tungsten, silicon, calcium and the like stabilize the phosphoric acid in the phosphate coating as well as they are oxidizable, they prevent the oxygen constituting the phosphoric acid from migrating to the soft magnetic powder by a temperature rise and are also capable of scavenging the oxygen coming from the outside to suppress the direct oxidation of the soft magnetic powder. In addition, although the silicone resin has high heat resistance in general as compared with the resin of the organic carbon compound type and has sufficient durability against the temperature rise at the time of use so as to maintain the insulating properties, metal oxides may act catalytically to the silicone resin and it becomes easy to produce silicon dioxide in the vicinity of the resin surface in a high temperature during the heat treatment. In accordance with this reaction, it is conceivable that the phosphoric acid-based coating film becomes reducible trend and indirectly inhibits the oxidation of the neighboring soft magnetic powder. For this action to be effective, it is necessary that the oxygen supply from the outside is blocked, and it is considered as essential that the silicone resin coating film has a sufficient thickness. In this regard, the silicone resin coating film having a thickness of approximately 10 nm or more is suitable.

Moreover, when the gap between the powder particles is large, it facilitates the supply by intrusion of the oxygen in the atmosphere and reactions are possibly promoted over time. Therefore, the issue of possibly reducing the gap between the powder particles is important for maintaining the heat resistance of the compact. In this regard, since the contact between the silicone resins has a very good lubricity so that the insulation-coated soft magnetic powder is easily compressed to high density, the powder particles in the compact obtained according to the above are in close contact with each other and have less clearance. Then the adhesion is also formed between the silicone resin coatings. Therefore, even if the temperature is raised to about 150° C. while using the compact as a reactor core, expansion of the gap, degradation and deterioration due to the reaction with the atmospheric air are extremely unlikely to occur between the particles of the soft magnetic powder in the compact. Consequently, even when used for a long time in a heated state, the magnetic permeability of the compact is stable and an increase in iron loss difficultly occurs.

In accordance with the structure that the thermal change with time is suppressed in the soft magnetic powder as described above, a compact stable in the magnetic permeability such that change with time (500 hours) of the effective magnetic permeability at 180° C. is about 3% or less, in particular about 1% or less, is provided and it shows a preferred electromagnetic properties as a powder magnetic core for a reactor. That is, in the powder magnetic core used as the reactor core, the coercive force is hardly changed even when the temperature rises, and increases with time in the hysteresis loss and iron loss can be suppressed.

EXAMPLES

[First Embodiment]

(Powder magnetic core A)

As the insulation-coated iron-based soft magnetic powder provided was a commercially available powder MH20D (manufactured by Kobe Steel, Ltd.). The powder MH20D is a powder according to Japanese Patent No. 4,044,591, that is an iron-based soft magnetic powder having a phosphoric acid-based chemical film and a silicone resin coating film formed in this order on the surface thereof (main particle fraction in the particle size distribution: 45 to 75 μm), wherein the above phosphoric acid-based chemical conversion film contains one or more elements selected from the group consisting of cobalt, sodium, sulfur, silicon and tungsten. The powder does not contain a kind of powder lubricant. The insulation-coating layer made of the above phosphoric acid-based chemical film and the silicone resin film is formed relatively uniform on the surface of the iron-based soft magnetic powder, and the film thickness in the thinnest portion of the insulation coating layer is about 50nrn. The powder MH20D was compacted at a compacting pressure of 1,200 MPa to prepare a green compact (density: 7.4 g/cm$^3$) of a ring shape having an outer diameter of 30 mm, an inner diameter of 20 mm and a height of 5 mm. After the compacting, heat treatment was performed by heating it to 600° C. to obtain a powder magnetic core A.

(Powder Magnetic Core B)

As the insulation-coated iron-based soft magnetic powder prepared was a powder of the category of Japanese Patent 4,927,983, that was an iron-based soft magnetic powder with an insulation layer containing a particulate metal oxide and calcium phosphate and being coated with a silicone resin. This powder does not contain a kind of powder lubricant, either. The insulation coating layer made of the insulation layer containing particulate metal oxide and calcium phosphate and of the silicone resin coat were formed unevenly on the surface of the iron-based soft magnetic powder, and the thickness of the insulation coating layer in the thinnest portion thereof was about 70 nm. The powder was compacted at a compacting pressure of 1,480 MPa to prepare a green compact (density: 7.4 g/cm$^3$) of a ring shape having an outer diameter of 30 mm, an inner diameter of 20 mm and a height of 5 mm. After the compacting, heat treatment was performed by heating it to 600° C. to obtain a powder magnetic core B.

(Powder Magnetic Core C)

For comparison, a powder, Somaloy 110i(5P) (main particle fraction in the particle size distribution: 106 to 150 μm) manufactured by Höganäs AB, was prepared as the commercially available iron-based soft magnetic powder being insulation-coated with phosphoric acid-based chemical conversion film. It is noted that the powder had contained a powder lubricant (ethylene-bis-stearic acid amide) and the surface of the phosphoric acid-based chemical film had been coated with the powder lubricant component. The above-described insulation coating layer made of the phosphoric acid-based chemical film and the powder lubricant component had been formed non-uniformly on the surface of the iron-based soft magnetic powder, and the thickness of the insulation coating layer was approximately 20 nm in the thinnest portion thereof. The powder was compacted at a compacting pressure of 1,200 MPa to prepare a green compact (density: 7.4 g/cm$^3$) of a ring shape having an outer diameter of 30 mm, an inner diameter of 20 mm and a height of 5 mm. After the compacting, heat treatment was performed by heating it to 600° C. to obtain a powder magnetic core C.

For each of the powder magnetic cores A, B and C prepared in the above, the cross section of the powder magnetic core was mirror polished. The cross section of the powder magnetic core was observed, respectively, at 3,000-fold magnification by means of EPMA, and the state of gapping between the powder particles was photographed. Using WinROOF produced by MITANI CORPORATION, the area ratio of gapping in the respective powder magnetic core was measured by setting the threshold to 85 in the mode method. As a result, the content of gapping between two powder particles, as an area ratio, was 0.7% for the powder magnetic core A, 1.0% for the powder magnetic core B, and 8.5% for the powder magnetic core C, respectively.

Using each of the powder magnetic cores A, B and C prepared in the above as a core, respectively, it was wound with a coil and allowed directly to stand in an atmosphere (air) heated to 180° C., without performing the potting. After that, the effective magnetic permeability $\mu_a$, the eddy current loss $W_e$ and the hysteresis loss $W_h$ were measured with time at frequency of 10 kHz and magnetic flux density of 100 mT, and the iron loss W was calculated. From the obtained values, the relationship between each of the items and the elapsed time was examined, respectively. The results are shown in FIG. 3 to FIG. 6.

Figure 3:
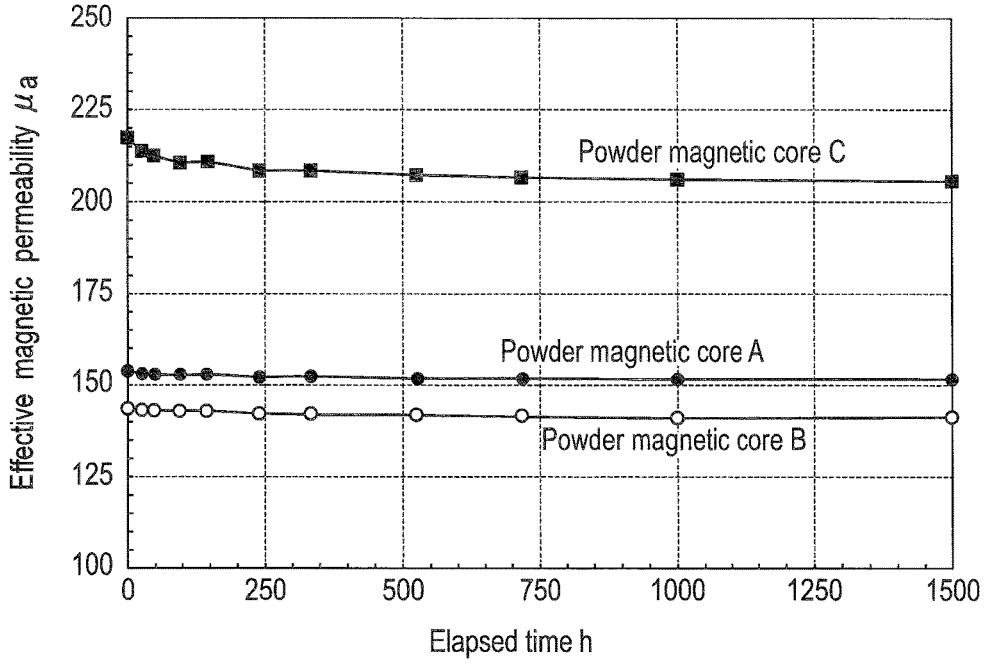
FIG. 3 A graph showing the changes in the effective magnetic permeability $\mu_a$ with the elapsed time, of the powder magnetic cores A to C in Example.

According to FIG. 3, in the powder magnetic core C, although the initial effective magnetic permeability $\mu_a$ is 217 and high, the effective magnetic permeability $\mu_a$ is decreased with the elapsed time to about 206, that is, the decreasing ratio (the ratio of the decreasing amount to the initial value) is about 5%. Meanwhile, in the powder magnetic core A, the initial effective magnetic permeability $\mu_a$ is about 154, and decrease in effective magnetic permeability $\mu_a$ with time is small and the decreasing ratio is about 1%. Similarly, also in the powder magnetic core B, the initial effective magnetic permeability $\mu_a$ is about 144, and decrease in effective magnetic permeability $\mu_a$ with time is small and the decreasing ratio is about 1%.

Figure 4:
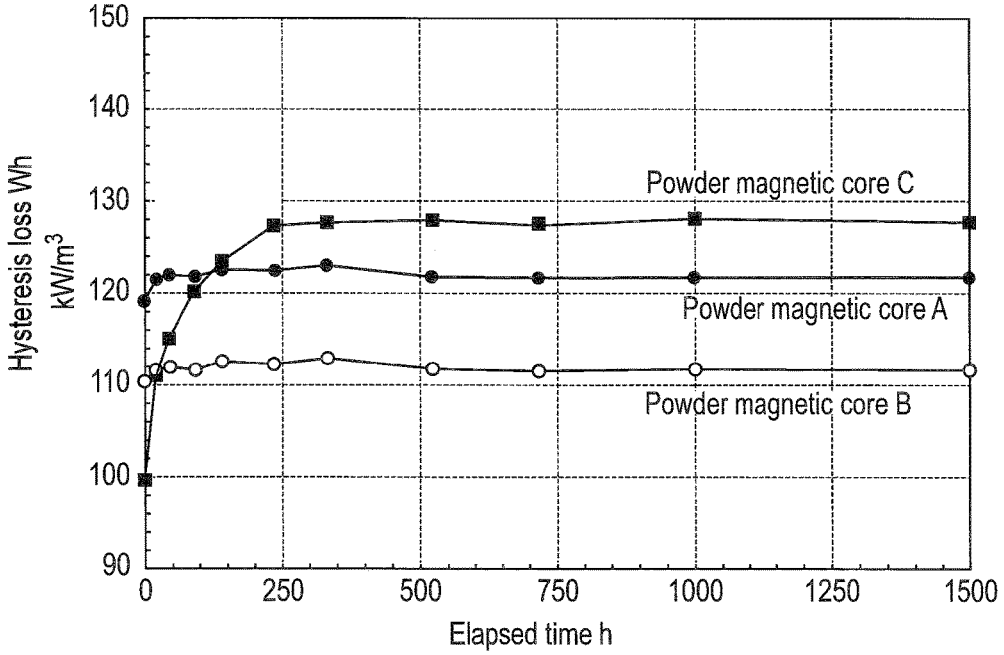
FIG. 4 A graph showing the changes in the hysteresis loss $W_h$ with the elapsed time, of the powder magnetic cores A to C.
Figure 5:
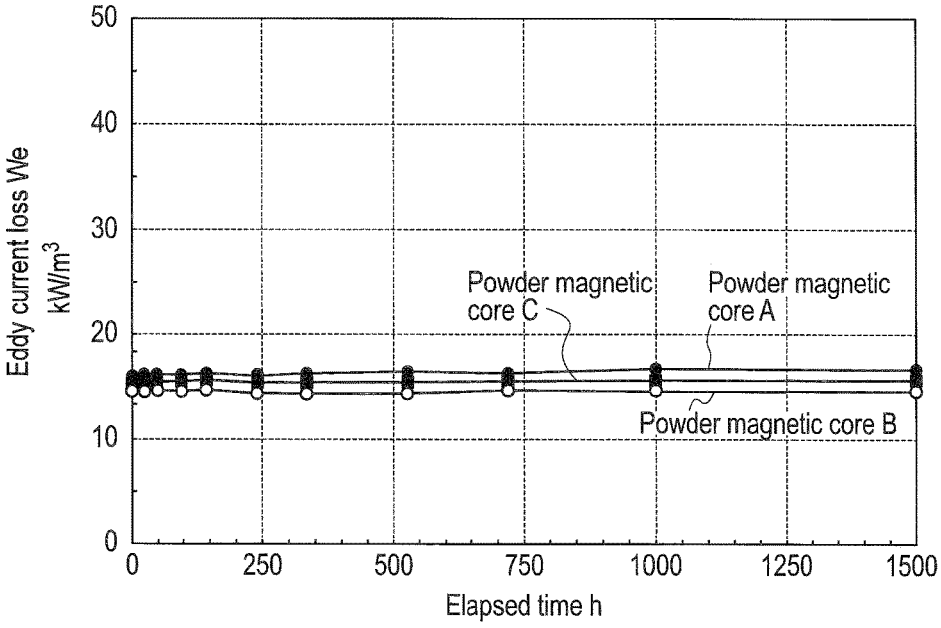
FIG. 5 A graph showing the changes in the eddy current loss $W_e$ with the elapsed time, of the powder magnetic cores A to C.

The resultant values of hysteresis loss $W_h$ measured for the powder magnetic cores A to C indicating the effective magnetic permeability $\mu_a$ as shown in FIG. 3 are shown in FIG. 4. In the powder magnetic core C that is large in change of the effective magnetic permeability $\mu_a$, the hysteresis loss $W_h$ which is initially about 100 kW/m$^3$ is increased up to about 128 kW/m$^3$ with the laps of time and, in other words, it has become about 1.3 times. On the other hand, in the powder magnetic cores A and B that the change in the effective magnetic permeability $\mu_a$ is about 1%, although the initial hysteresis loss $W_h$ is higher than the powder magnetic core C and 119 kW/m3 or 110 kW/m3, respectively, the hysteresis loss $W_h$ does not increase even after the lapse of time and becomes ultimately a lower value than the powder magnetic core C.

The eddy current loss $W_e$ in any of the powder magnetic cores A to C indicates a stable value regardless of the time elapsed.

Figure 6:
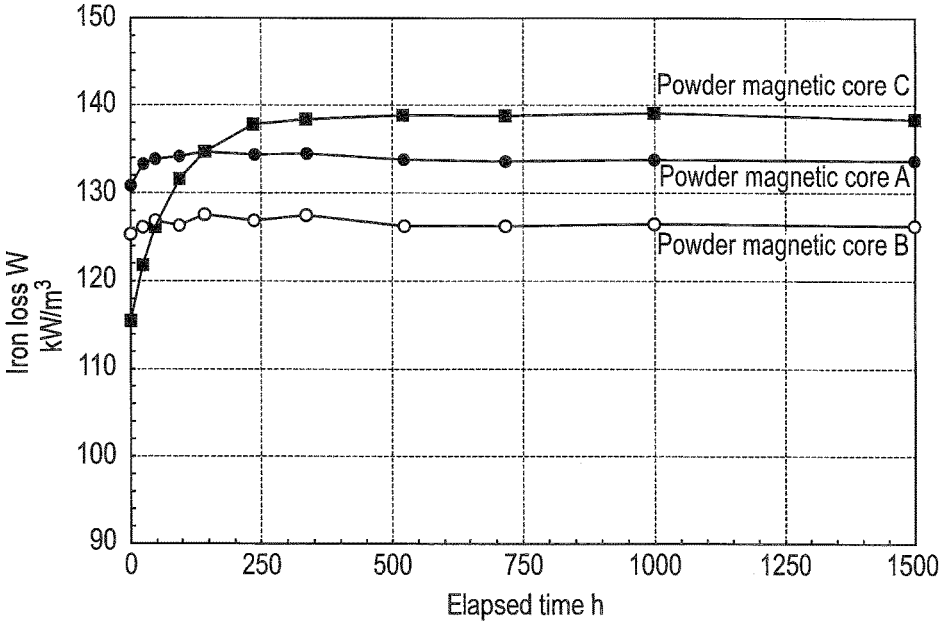
FIG. 6 A graph showing the changes in the iron loss W with the elapsed time, of the powder magnetic cores A to C.

From the results of the above hysteresis loss $W_h$ and eddy current loss $W_e$, it can be seen for the iron loss W, as described below. That is, as shown in FIG. 6, the iron loss W is increased with time in the powder magnetic core C that has large change in effective magnetic permeability $\mu_a$. In contrast, in the powder magnetic cores A and B that change in effective magnetic permeability $\mu_a$ is about 1%, although the initial iron loss W is higher than that of the powder magnetic core C, the iron loss W does not increase with elapsed time and has eventually a value lower than the powder magnetic core C. From the above, it is clear that, when applying a powder magnetic core to the core of a reactor which is not subjected to potting, increasing in iron loss W with time is possibly suppressed by using a powder magnetic core in which the proportion of change with time in the magnetic permeability due to the heat is about 1%.

Figure 7:
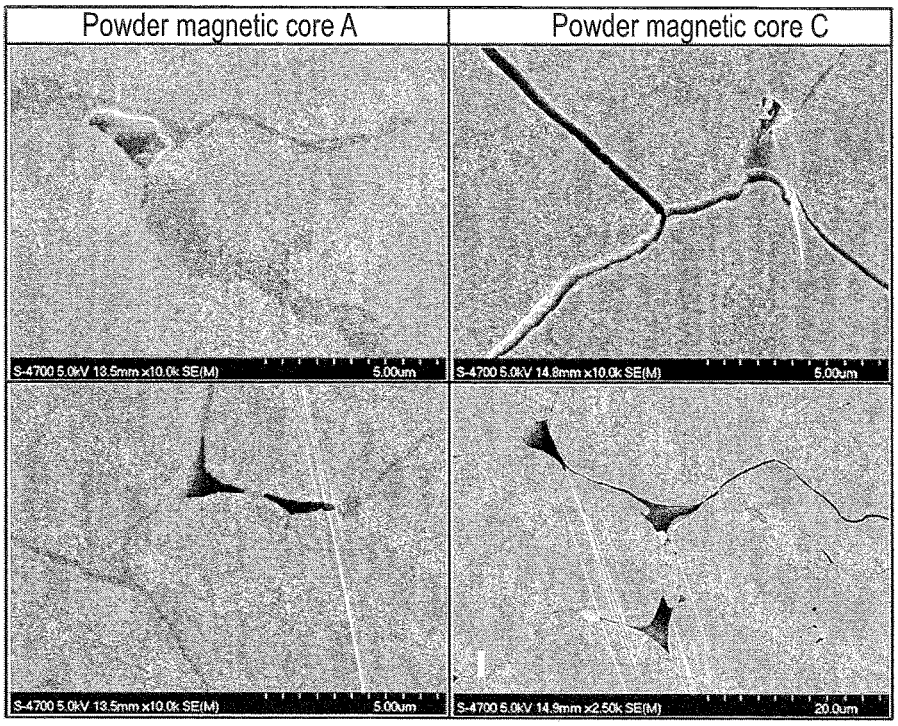
FIG. 7 Scanning electron micrograph images showing the state of gaps between the particles in the cross-section, respectively, of the powder magnetic cores A and C.

The results of observation of the cross-section of the powder magnetic cores A and C by the scanning electron microscope are shown in FIG. 7. In the powder magnetic core A containing no powder lubricant, almost no gapping is observed between two adjacent particles of the insulation-coated iron-based soft magnetic powder, and the void (pore) formed by three or more particles of the insulation-coated iron-based soft magnetic powder is in the state of closed pore. Therefore, the interior of the powder magnetic core A is shut off from the outside air, and oxidation of the iron-based soft magnetic powder is unlikely to proceed. Meanwhile, in the powder magnetic core C using the insulation-coated iron-based soft magnetic powder whose surface is coated with the powder lubricant, gap is obviously formed between two adjacent particles of the insulation-coated iron-based soft magnetic powder, and the void (pore) formed by three or more particles of the insulation-coated iron-based soft magnetic powder is in the state of open pore. Therefore, in the powder magnetic core C, the gap formed between two adjacent particles of insulation-coated iron-based soft magnetic powder makes a communicating hole and the outside air is led to the inside of the powder magnetic core, so that the iron-based soft magnetic powder is in the state that oxidation easily proceeds. Therefore, it is considered that the progress of oxidation of the iron-based soft magnetic powder has resulted in the change with time in the effective magnetic permeability $\mu_a$.

[Second Embodiment]

As the raw material powder, a commercially available powder MH20D (manufactured by Kobe Steel, Ltd.), which was used in the preparation of the powder magnetic core A of the First Embodiment, was prepared, and a zinc stearate powder provided as a powder lubricant was dissolved in ethanol to prepare a powder lubricant solution. The raw material powder was dipped in the powder lubricant solution in such a proportion of the powder lubricant to the raw material powder as shown in Table 1, and it was stirred and allowed to volatize ethanol, whereby the surface of the raw material powder was coated with the powder lubricant. Using the raw material powder obtained above, each of powder magnetic cores of Sample Nos. A1 to A7 was prepared by compacting it in the manner similar to the powder magnetic core A of the First Embodiment, and the content of gapping between two powder particles was measured. Further, using each of the produced powder magnetic cores as the core, the effective magnetic permeability $\mu_a$, the eddy current loss $W_e$ and the hysteresis loss $W_h$ were measured with time on the same conditions as the First Embodiment, and the iron loss W was calculated. Then the relationship between the elapsed time and the value of each item in the heated atmosphere was examined. For each of the powder magnetic cores of Sample Nos. A1 to A7, the gapping content, the effective magnetic permeability $\mu_a$ at the initial stage and after a lapse of 528 hours, and the ratio of change in the effective magnetic permeability $\mu_a$ during this period [=100×(528-hour value−initial value)/initial value, (%)] are shown in Table 1, and the values at the initial stage and after 528 hours of each of the eddy current loss $W_e$, the hysteresis loss $W_h$ and the iron loss W are shown in Table 2. Incidentally, in Table 1 and Table 2, the values measured for the powder magnetic core A, the powder magnetic core B and the powder magnetic core C produced in the First Embodiment are also shown together as Sample No. A, Sample No. B and Sample No. C, respectively.

TABLE 1

| Sample No. | Lubricant content mass % | Gapping content area % | Effective magnetic permeability μa Initial | After lapse of 528 hr | Ratio of change % | Remarks |
|---|---|---|---|---|---|---|
| A | 0 | 0.7 | 153.5 | 152.1 | −0.95 | Powder magnetic core A |
| A1 | 0.01 | 0.9 | 153.1 | 151.6 | −0.98 | Powder magnetic core A + Lubricant |
| A2 | 0.03 | 1.2 | 153.7 | 152.2 | −0.98 | Powder magnetic core A + Lubricant |
| A3 | 0.05 | 2.0 | 152.7 | 151.2 | −1.00 | Powder magnetic core A + Lubricant |
| A4 | 0.07 | 2.1 | 152.4 | 150.1 | −1.50 | Powder magnetic core A + Lubricant |
| A5 | 0.10 | 3.7 | 151.6 | 147.5 | −2.70 | Powder magnetic core A + Lubricant |
| A6 | 0.30 | 6.9 | 152.3 | 147.0 | −3.50 | Powder magnetic core A + Lubricant |
| A7 | 0.40 | 8.7 | 151.8 | 145.0 | −4.50 | Powder magnetic core A + Lubricant |
| B | 0 | 1.0 | 143.5 | 142.1 | −1.01 | Powder magnetic core B |
| C | 0.40 | 8.5 | 216.6 | 206.9 | −4.47 | Powder magnetic core C |

TABLE 2

| Sample No. | Lubricant content mass % | Initial Eddy current loss We kW/m³ | Initial Hysteresis loss Wh kW/m³ | Initial Iron loss W kW/m³ | After laps of 528 hr Eddy current loss We kW/m³ | After laps of 528 hr Hysteresis loss Wh kW/m³ | After laps of 528 hr Iron loss W kW/m³ | Remarks |
|---|---|---|---|---|---|---|---|---|
| A | 0 | 16.1 | 119.1 | 135.1 | 16.5 | 121.7 | 138.2 | Powder magnetic core A |
| A1 | 0.01 | 16.2 | 119.3 | 135.5 | 16.4 | 121.8 | 138.2 | Powder magnetic core A + Lubricant |
| A2 | 0.03 | 16.1 | 119.4 | 135.5 | 16.5 | 121.9 | 138.4 | Powder magnetic core A + Lubricant |
| A3 | 0.05 | 16.1 | 119.6 | 135.7 | 16.5 | 122.1 | 138.6 | Powder magnetic core A + Lubricant |
| A4 | 0.07 | 16.2 | 119.4 | 135.6 | 16.4 | 125.5 | 141.9 | Powder magnetic core A + Lubricant |
| A5 | 0.10 | 16.3 | 119.4 | 135.7 | 16.4 | 130.4 | 146.8 | Powder magnetic core A + Lubricant |
| A6 | 0.30 | 16.2 | 119.5 | 135.7 | 16.4 | 142.8 | 159.2 | Powder magnetic core A + Lubricant |
| A7 | 0.40 | 16.2 | 119.6 | 135.8 | 16.4 | 150.1 | 166.5 | Powder magnetic core A + Lubricant |
| B | 0 | 14.7 | 110.5 | 125.2 | 14.5 | 111.7 | 126.2 | Powder magnetic core B |
| C | 0.40 | 15.7 | 99.7 | 115.3 | 15.5 | 127.9 | 143.3 | Powder magnetic core C |

The powder magnetic cores of Sample Nos. A1 to A7 contain a powder lubricant. According to the results shown in Table 1 and Table 2, the ratio of change in the effective magnetic permeability $\mu_a$ is a small value of −1% in the powder magnetic core of Sample No. A3 that the amount of the powder lubricant is a trace amount of 0.05% by mass, and thus increase in the hysteresis loss $W_h$ is very small and increase of iron loss W is also quite small. On the other hand, in the powder magnetic cores of Sample No. A4 to A7 that the amount of powder lubricant is more than 0.05% by mass, the ratio of decrease (=ratio of change/−1) in the effective magnetic permeability $\mu_a$ rapidly increases beyond 1% in accordance with increase of the powder lubricant amount, and the hysteresis loss $W_h$ and the iron loss W increase. In other words, decrease of the effective magnetic permeability $\mu_a$ is small in Sample No. A3 that the content of gapping between two powder particles is a small value of 2%, and decrease of the effective magnetic permeability $\mu_a$ is large in Sample Nos. A4 to A7 the content of gapping between two powder particles is large. From these results, the following two points are clear, that is, the blending amount of the powder lubricant and the content of gapping between two powder particles are correlated, and the decrease of the effective magnetic permeability $\mu_a$ becomes large in accordance with increase of the gapping content between two powder particles. Thus it can be said to be a cause of decreasing in the effective magnetic permeability $\mu_a$ that deterioration (oxidation) of the iron-based soft magnetic powder inside the powder magnetic core is likely to proceed by increase of the gapping content between two powder particles.

In Table 1, focusing on the relationship between the amount of the powder lubricant and the content of gapping between two powder particles, it is almost a linear relationship. In contrast, focusing on the relationship between the ratio of change in the effective magnetic permeability $\mu_a$ and the content of gapping between two powder particles, the ratio of change in the effective magnetic permeability $\mu_a$ is constant at about −1% in the range that the gapping content is 2% by area or less, and, if the gapping content exceeds 2% by area, decrease of the effective magnetic permeability $\mu_a$ abruptly becomes large. From this fact, it is understood that communication of gaps becomes significant when the gapping content exceeds 2% by area. This point also can be seen from the relationship between the amount of the powder lubricant and the effective magnetic permeability $\mu_a$, and decrease in the effective magnetic permeability $\mu_a$ is especially remarkable when the amount of the powder lubricant is more than 0.05% by mass. That is, it is understood that, when the amount of powder lubricant is more than 0.05 mass %, the communication of gaps caused by the powder lubricant becomes significant so that decrease in the effective magnetic permeability due to internal oxidation proceeds. Therefore, if using a powder lubricant, it is preferred to limit the added amount to 0.05 mass % or less in order to suppress the gapping content between two powder particles to 2 area % or less.

As described above, it has been confirmed that, for use of the powder magnetic core suitably as a reactor core in the state exposed to the atmosphere without potting, it is important to configure the powder magnetic core in such a manner that the ratio of decrease in the effective magnetic permeability is 1% or less, in order to suppress the increase of iron loss due to the time of use. Moreover, it is effective, for achieving the ratio of decrease in the effective magnetic permeability $\mu_a$ of 1% or less, to suppress 2 vol % or less the gapping content between two adjacent particles of the insulation-coated iron-based soft magnetic powder in the green compact. This item can be approximated as the gapping content between two powder particles in a cross section that is 2 area % or less. Since a communicating hole is easily formed in the powder magnetic core when the powder lubricant is contained in the raw material powder, it is preferred to use a raw material powder which does not contain the powder lubricant, and, if using the powder lubricant, the content of the powder lubricant is set to be 0.05 mass % or less. The powder magnetic core configured as described above is thus a ready-to-use powder magnetic core for a reactor without potting, and it is to suitably function as the core of the reactor in the state exposed to the atmosphere.

INDUSTRIAL APPLICABILITY

A powder magnetic core which shows good magnetic properties in the high frequency range is provided, and it exhibits superior performance when used as a core of a booster circuit such as a reactor, an ignition coil and the like, or of a circuit used in a high magnetic field and in a high frequency range, such as a choke coil, a noise filter and the like. It contributes to improving the performance of various products for high frequency and also supports the use in the range of a commercial frequency to medium frequency, such as electrical components and automotive or general industrial motor core, thereby enabling the supply of highly versatile products.

The invention claimed is:

1. A powder magnetic core for a reactor, to be applied to a reactor that is used in a state that a core is exposed without being potted, consisting essentially of:

a compact formed of an insulation-coated iron-based soft magnetic powder that an insulating film is formed on the surface of a metallic iron-based soft magnetic powder whose main particle fraction in the particle size distribution is 45 to 75 μm, and having a compact density of 7.4 g/cm 3 or more, wherein the insulating film is a laminate film comprising a phosphoric acid-based chemical conversion coating at the inner side thereof and a silicone resin coating at the outer side thereof, and a content of gapping between two adjacent particles of the insulation-coated iron-based soft magnetic powder in the compact is 2% by volume or less than 2% by volume.

2. The powder magnetic core for a reactor as set forth in claim 1, wherein the phosphoric acid-based chemical conversion coating contains at least one element selected from the group consisting of cobalt, sodium, sulfur, silicon and tungsten.

3. The powder magnetic core for a reactor as set forth in claim 1, wherein the thickness of the insulating film is at least 50 nm.

4. The powder magnetic core for a reactor as set forth in claim 1, wherein the compact is a heat-treated product of a compaction-formed body of the insulation-coated iron-based soft magnetic powder that a content of a powder lubricant is 0.05% by mass or less than 0.05% by mass, and the compact consists of the insulation-coated iron-based soft magnetic powder by decomposition of the powder lubricant.

5. The powder magnetic core for a reactor as set forth in claim 1, wherein the compact is a heat-treated product of a compaction-formed body of the insulation-coated iron-based soft magnetic powder that contains no powder lubricant, and the compact consists of the insulation-coated iron-based soft magnetic powder.

* * * * *